US011289255B2

(12) United States Patent
Stone, III et al.

(10) Patent No.: US 11,289,255 B2
(45) Date of Patent: Mar. 29, 2022

(54) RELATIVE TILT ANGLE ADJUSTMENT SYSTEM FOR MAGNETIC COMPONENTS

(71) Applicant: Bruker BioSpin GmbH, Rheinstetten (DE)

(72) Inventors: William Jefferson Stone, III, Ferndale, WA (US); Lukas Haenichen, Karlsruhe (DE)

( * ) Notice: Subject to any disclaimer, the term of this patent is extended or adjusted under 35 U.S.C. 154(b) by 97 days.

(21) Appl. No.: 16/998,187

(22) Filed: Aug. 20, 2020

(65) Prior Publication Data

US 2022/0059268 A1 Feb. 24, 2022

(51) Int. Cl.
*H01F 7/02* (2006.01)
*H01F 41/02* (2006.01)

(52) U.S. Cl.
CPC ..... *H01F 7/021* (2013.01); *H01F 41/0253* (2013.01)

(58) Field of Classification Search
CPC ..... H01F 7/021
See application file for complete search history.

(56) References Cited

U.S. PATENT DOCUMENTS 4,093,912 A 6/1978 Double et al.
5,729,188 A 3/1998 Siebold et al.
11,075,027 B1 * 7/2021 Price ..... H01F 7/021
2017/0120401 A1 * 5/2017 Fullerton ..... B23P 15/001
2018/0244224 A1 8/2018 Job

FOREIGN PATENT DOCUMENTS

DE 1096795 B 1/1961
DE 3008598 C2 6/1988
DE 3737133 A1 5/1989
DE 102006002576 A1 7/2007
DE 102015221800 B4 * 8/2018 ..... B25B 11/002
EP 0488015 A1 6/1992
EP 0757364 A2 2/1997

* cited by examiner

*Primary Examiner* — Mohamad A Musleh
(74) *Attorney, Agent, or Firm* — Benoit & Côté Inc.

(57) ABSTRACT

An adjustment apparatus for adjusting the angular tilt of a first component of a magnetic circuit relative to an alignment axis of a second component of the circuit uses at least one pair of spacers each of which has a thickness that changes continuously around its periphery. The spacers are arranged between the circuit components and, as a relative rotation between the spacers is changed, the combined thickness of the two spacers increases in one area, while decreasing in another. This results in a tilting of a top surface of the spacer pair relative to a bottom surface, and a corresponding change in a relative tilt of the first component relative to the second component. The spacers may be ring-shaped or disc-shaped, and allow for precise alignment of the magnetic circuit without the need for shims between the components.

22 Claims, 7 Drawing Sheets

RELATIVE TILT ANGLE ADJUSTMENT SYSTEM FOR MAGNETIC COMPONENTS

BACKGROUND OF THE INVENTION

Field of the Invention

This invention relates generally to assemblies of magnetic components and, more specifically, to the relative tilt adjustment of such components for calibrating magnetic fields.

Description of the Related Art

Many scientific instruments, industrial processes, and medical imaging instruments use strong homogeneous magnetic fields in operation. Magnetic Resonance Imaging (MRI), NMR, EPR and Electromagnetic Processing of Material (EPM) are examples where strong magnetic fields are a key element of their function and performance. The strong magnetic fields used by such apparatus may be produced using different components, such as permanent magnets, resistive magnets, and supercooled magnets. Regardless of the specific components used, many devices direct and focus a magnetic field within a volume of interest (VOI) within which VOI materials or samples can be subjected to the effects of the magnetic field.

A typical VOI is often a space between two parallel planar surfaces, i.e. pole pieces, of the magnetic circuit, often referred to as a "working gap." It is usually of critical importance that the magnetic field in such a VOI is homogeneous, and characterized by a uniform strength and highly parallel magnetic field lines across a region of interest. Many factors can affect the field homogeneity in this region, such as anisotropies or inhomogeneities in the metals and materials used to fabricate and construct a particular magnetic circuit. Many of these inhomogeneities can be corrected for by controlling the geometric configurations and relative orientations of the components, particularly at the faces of the working gap.

A typical magnetic circuit might include a magnetic field generation source, such as a permanent magnet, resistive magnet or superconducting magnet, a magnetically-permeable structure, often referred to as a "yoke," and pole pieces, which are often referred to as "faces" or "shoes." The composition, geometry, position and orientation of the pole pieces are often selected or modified in a way that achieves an acceptable level of field homogeneity across a useful portion of the of the working gap. Of the many reasons for adjusting the pole pieces in a magnetic assembly, achieving parallelism across the volume of interest is one of the most critical. Across the faces of the opposing pole pieces, small variations in their relative separation can have a considerable effect on field uniformity. In angular terms, a misalignment of as little as three or four minutes of arc can be unacceptable for some devices to perform satisfactorily.

A common method of adjusting for parallelism involves loosening an attachment mechanism that secures an element to be adjusted, and then adjusting one or more "jacking" screws to move the element away from a mounting surface. This opens a gap into which one or more thin metal shims of various thicknesses are inserted at appropriate places around the periphery of the element whose angular orientation is to be adjusted. A jacking screw arrangement of this type is shown schematically in FIGS. 1A and 1B, in which a first part 10 is seated against a second part 12, and the two parts must be aligned about a common axis of rotation 14. To provide an adjustment in the relative tilt of the parts 10, 12, a jacking screw 16 is provided in a threaded hole in part 10. Adjustment of the jacking screw 16 creates a separation between the parts at a specific location, resulting in a change in the relative angular tilt of the parts, and the opening of a gap between them. Shims may then be placed in the gap, and the attachment mechanism re-secured so as to fix the two parts in their new relative orientation.

When the parts are elements in a magnetic circuit (e.g., a magnetic return path or yoke), problems can result from the use of the method discussed above, as gaps between the two parts cause problems such as breaks in the magnetic circuit, additional flux leakage and a decrease in the base field. The gaps may also break a thermal circuit, since thermal coupling between the two parts is interrupted and a thermal gradient can be introduced, which can be problematic if the parts are to have a stable relative temperature. In addition, mechanical support between the parts may be impaired, and the center of gravity distance between them is increased. Moreover, the shimming process can degrade the magnetic performance by reducing the physical contact area and lead to field saturation across that area, as well as resulting in an undefined lateral displacement of the pole faces, a lack of defined poles of displacement or a lack of a defined pivot center.

SUMMARY OF THE INVENTION

In accordance with the present invention, a system for adjusting the relative angular tilt between magnetic parts is provided that has minimal impact on magnetic circuit integrity and contact cross-sectional area. In particular, the angular tilt of a first component may be adjusted relative to an alignment axis of a second component of the magnetic circuit using a novel pair of spacers. A first spacer of the pair has a thickness, as measured between one side (a first support surface) and an opposite side (a first adjustment surface), that varies continuously along a periphery of the spacer. In particular, the thickness changes from a minimum to a maximum over an angular range of 180° about the alignment axis. Similarly, a second spacer of the pair has a thickness, as measured between one side (a second support surface) and an opposite side (a second adjustment surface) that also changes from a minimum to a maximum over an angular range of 180° about the alignment axis.

The two spacers are arranged with their respective adjustments surfaces adjacent to each other, so that a relative rotation between the spacers about the alignment axis results in a change in the relative angular orientation of the first support surface and the second support surface. When the spacer pair is located between the two components, so that the first support surface is adjacent to the first component and the second support surface is adjacent to the second component, the change in the relative angular orientation of the spacer support surfaces results in a corresponding change in the relative angular tilt of the first component relative to the alignment axis of the second component. Throughout the adjustment of the spacers, surface contact between the adjustment surfaces is maintained, as is the surface contact between the first support surface and the first component and the surface contact between the second support surface and the second component.

In an exemplary embodiment, the two spacers are arranged so that, at a minimum adjustment position, the maximum thickness of the first spacer is rotationally aligned with the minimum thickness of the second spacer while, at a maximum adjustment position, the maximum thickness of the first spacer is rotationally aligned with the maximum thickness of the second spacer. The shapes of the two spacers are thus complementary, allowing for a continuous range of tilt adjustment. In the exemplary embodiment, the second support surface is perpendicular to the alignment axis and, at a minimum adjustment position, the first support surface is parallel to the second support surface. Thus, the minimum tilt adjustment is zero, with the maximum being when the two spacers have a relative rotation of 180° between them. The two spacers may also have an identical shape, with one inverted relative to the other.

The spacers may be centered relative to the alignment axis and, in one embodiment of the invention, they are ring-shaped to allow an interior space to be occupied by a portion of one of the components. In another embodiment, the spacers are disc-shaped, although other shapes are also possible. In yet another embodiment, two sets of spacers are provided, one being a coarse set for a coarse adjustment of the angular tilt, and the other being a fine set for a fine adjustment of the angular tilt. The two spacer sets may have an identical form except that the variation in thickness of the fine set over the 180° angular range is significantly less than a corresponding thickness variation of the coarse set over the same range. The two sets are located adjacent to each other in between the two components. In this way, a coarse adjustment in the angular tilt may be achieved by changing the relative rotational position of the spacers of the coarse set, while a fine adjustment may be achieved by changing the relative rotational position of the fine set.

In one embodiment, friction bearings are used between at least some of the surfaces of the system so as to reduce the friction resistance during adjustment. At least one of the spacers may also be provided with a feature that can be engaged with a tool (either manual or automatic), such that the relative rotational adjustment of the spacer pair may be performed by rotation of the tool. The components of the magnetic circuit may also be adapted to the rotationally-adjustable spacer pair so as to minimize any radial movement relative to the alignment axis. For example, at least one of the components may have an obstructing feature that minimizes relative radial movement of the first component relative to the second component (and therefore relative to the alignment axis), and the obstructing feature may have a curved surface that minimizes friction between the first component and the second component during adjusting of the angular tilt. Such an obstructing feature may also be located so as to minimize relative radial movement between the spacers and the second component.

DETAILED DESCRIPTION

The present invention provides a system for fine continuous angular tilt adjustment between two magnetic components, such as pole faces, having two degrees of freedom. The system uses wedged rings or circular plates that provide continuous face contact between a pole piece and a core piece. For example, in a magnetic arrangement fixed to a cover plate, wedged rings or discs are arranged between the cover and a carrying structure, or within a cylindrical yoke. Relative rotation of the rings or plates may then be used to provide a desired degree of tilt between them, while preserving the cross-sectional contact area between the magnetic elements and maintaining the integrity of the magnetic circuit.

Figure 1A:
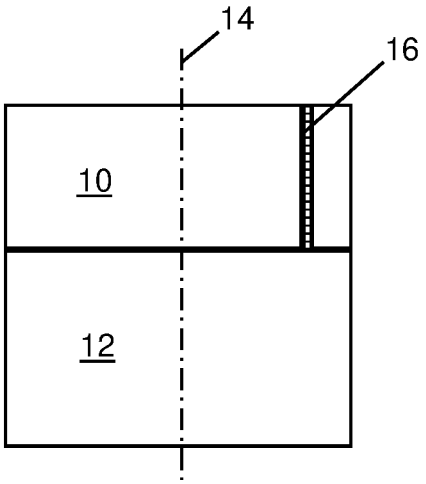
FIGURE 1A (PRIOR ART)
FIG. 1A is a schematic view of a prior art adjustment system that makes use of a jacking screw to adjust a relative angular tilt between two components.
Figure 1B:
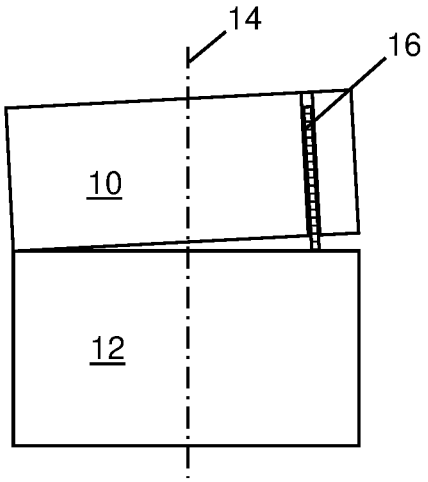
FIGURE 1B (PRIOR ART)
FIG. 1B is a schematic view of the system shown in FIG. 1A showing a gap between the components after adjusting the jacking screw.
Figure 2A:
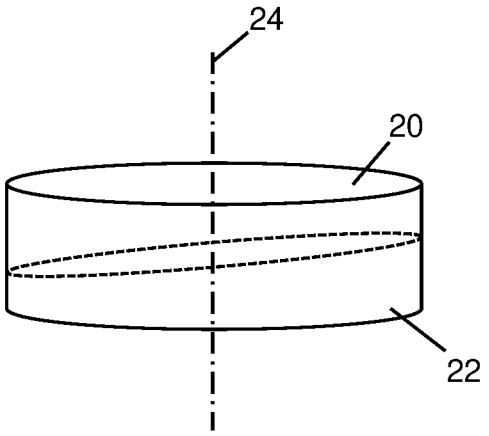
FIG. 2A is a schematic view of two disc-shaped spacers for which a relative rotational adjustment changes an angular orientation with regard to a central axis.
Figure 2B:
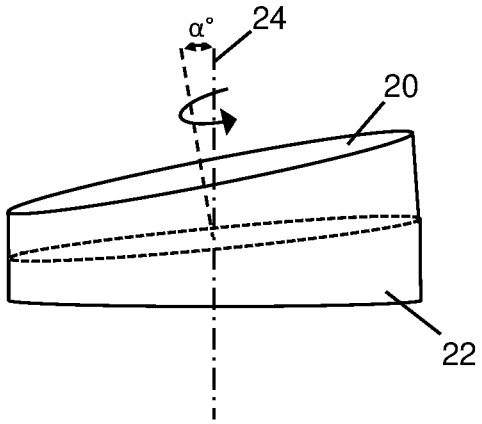
FIG. 2B shows the relative orientation of the spacers of FIG. 2A after adjustment.

Shown in FIGS. 2A and 2B are two cooperating disc-shaped components 20, 22 that contact each other across a large surface area between their contact faces. The two components have a common angular alignment about a principal axis 24, and the contact faces meet at a plane for which a perpendicular axis is angularly offset relative to the axis 24. In the relative orientation of FIG. 2A, the components 20 and 22 share the principal axis 24, but upon rotation of component 20 relative to component 22 about the axis 24, a relative tilt between them develops due to the angular offset of the contact faces. Thus, as shown in FIG. 2B, the orientation of component 20 relative to component 22 changes by an angle α in a first direction. However, despite this change in relative angular orientation, the two components remain in contact across the contact faces. Moreover, the magnitude of the relative tilt a increases with the rotation between the two components, allowing for a continuous range of angular adjustment.

To achieve the relative tilt between the two components, the lateral position of the components must be preserved. It may also be difficult to machine the desired tilt into the contact surfaces of the parts if they have complex shapes, as is often the case.

However, in the form shown, the two components may function as a pair of spacers that are located between two components of a magnetic circuit for which an adjustment of relative angular tilt may be necessary. As opposed to jack screws and shims that are common in the prior art, the disc-shaped spacers 20, 22 allow for minor adjustments in the angular tilt of adjacent components without the creation of a gap, or the need for shims to fill such a gap. With the magnetic circuit components being in contact, respectively, with the outer support surfaces of the spacers 20, 22, a rotation of one of the spacers relative to the other creates a relative angular tilt between those support surfaces and, correspondingly, between the adjacent magnetic circuit components.

Figure 3:
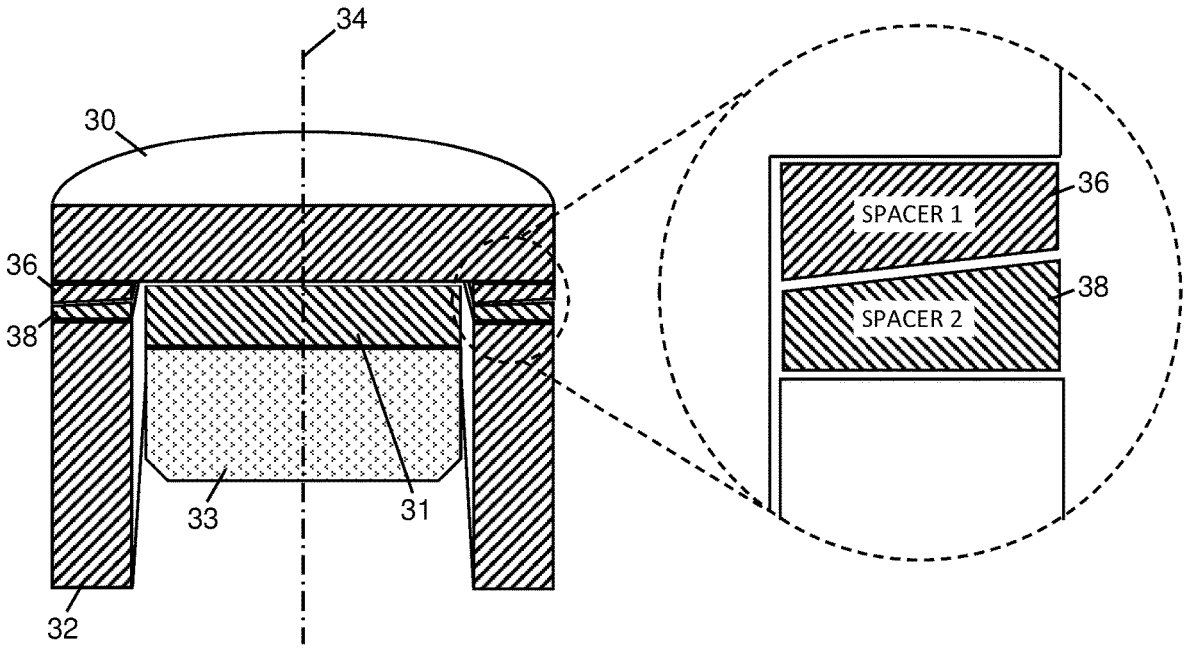
FIG. 3 is a schematic, cross-sectional view of the components of a magnetic circuit and an exemplary embodiment of the adjustment system according to the present invention that may be used to change the relative angular tilt of the components.

It is also possible to provide such an adjustment system without the spacers occupying an entire space between the adjacent magnetic components. In an alternative embodiment, an adjustment system uses a set of spacers in the form of slanted rings, such that the contact surfaces are limited to a periphery of the parts to be adjusted. Shown in FIG. 3 is a cross-sectional schematic representation of a first part 30, which might be a cover plate for a magnetic assembly to which magnetic circuit components, such as a permanent magnet 31 and a pole piece 33, are attached. The part 30 is mounted on a second part 32, which might be a yoke of the magnetic assembly, with the parts 30, 32 sharing a relative rotational axis 34. In order to provide an adjustment in the relative angular tilt between the two parts, a set of annular spacers 36, 38 are provided between the peripheral contact surfaces of the parts 30, 32.

As shown in the principal portion of the figure, as well as in the enlargement of the spacer cross sections, at a minimum adjustment position, each spacer has a support surface that follows a direction perpendicular to the rotational axis 34 and that contacts a respective one of the parts. Each spacer also has an opposite surface that follows a direction that is not perpendicular to the rotational axis 34, and that is in contact with, and complementary to, a corresponding surface of the other spacer. In particular, the contact surfaces between the two spacers are oriented along a common plane, similar to the example of FIGS. 2A and 2B, but are of annular shape rather than disc-shaped. Rotation of one of the spacers relative to the other about the axis 34 therefore results in a relative tilt between the parts 30 and 32, the magnitude of which depends on the extent of the relative rotation. As in the example of FIGS. 2A and 2B, the adjustment system of FIG. 3 therefore allows for an adjustment of the relative angular orientations of the two parts 30, 32, while maintaining full contact between the surfaces of the spacers.

Figure 4:
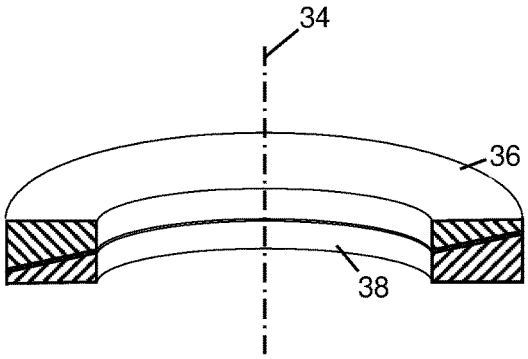
FIG. 4 is a schematic, cross-sectional view of the spacer components of an adjustment system like that used in FIG. 3.

A schematic cross-sectional view of the spacers is shown in FIG. 4. In this embodiment, the two spacers are identical, albeit in an inverted orientation relative to each other. However, those skilled in the art will understand that the two spacers can be different, each having a different overall thickness, although using identical spacers reduces the necessary number of different parts. Moreover, if the relative tilt angle between the top and bottom surfaces for the two spacers is different, there will be no neutral "zero" position at which the overall tilt provided by the pair is 0°. When arranged as shown in the figure, the spacers 36, 38 together have a uniform thickness such that a top surface of spacer 36 follows a plane that is parallel to a bottom surface of the spacer 38. Thus, when located between two parts, the spacers in this relative orientation would provide a constant offset between those parts. Because of the wedge shape of each spacer, however, rotation of the spacer 36 relative to the spacer 38 about the axis 34 results in a top surface of the spacer 36 being tilted such that it follows a plane that is not parallel to the plane of the bottom surface of spacer 38. As such, any part that rests in contact with the top surface of the spacer 36 would have tilt relative to the orientation of a part that rests in contact with the spacer 38.

As the relative rotation between the spacers 36, 38 increases, the degree of tilt between them increases. This increase in tilt reaches a maximum at a relative rotation of 180° between the spacers, at which point the angular adjustment provided relative to a rotation of 0° is twice the angular difference between the plane in which one side of a spacer resides and the plane within which the opposite side of the spacer resides. That is, if an angular difference between the plane of one side of a spacer and the plane of the opposite side is x°, the maximum tilt adjustment between two parts in contact with the two spacers, respectively, is 2x°.

Those skilled in the art will recognize that the tilt adjustment achieved is dependent on the relative position of the two spacers, but that the direction of the tilt is dependent on the rotational orientation of the spacer pair itself. Thus, a relative rotational position of the two spacers may produce a tilt of x° in a first angular direction relative to the rotation axis 34. If this relative rotational position between the spacers is retained and the spacer pair is rotated together about the axis 34, the angular direction of the tilt will rotate as well. Thus, to provide a desired degree of tilt in a desired direction, it is necessary to both set the relative rotation of the spacers to establish the degree of tilt, and to set the rotational position of the spacer pair to establish the direction of tilt.

Figure 5:
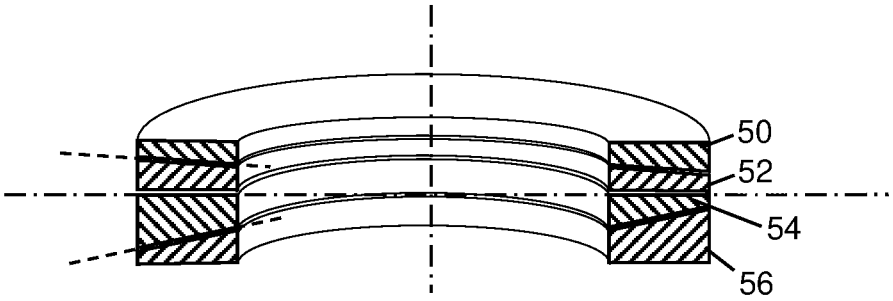
FIG. 5 is a schematic, cross-sectional view of an alternative embodiment of the invention in which two pairs of spacers are used to provide coarse and fine adjustments of the relative angular tilt between components.

In an alternative embodiment of the invention, a set of spacer rings is used that provides both a coarse and fine adjustment. As shown in FIG. 5, two pairs of spacer rings are provided, each of which has a similar configuration to the rings shown in FIG. 4. In this embodiment, however, the spacers 50, 52 each have a tilt angle difference between their top and bottom surfaces that is much lower than that of the spacers 54, 56. The two sets of rings meet at a plane that is parallel to the top surface of the ring set 50, 52 and the bottom surface of the ring set 54, 56 when each ring set is at a relative rotation of 0°. Like the embodiment of FIG. 4, each of the ring sets can be adjusted to provide a relative rotation between the rings of that set, thereby creating a relative tilt angle between the top and bottom surfaces of that ring set. However, because of the larger tilt angle of the ring set 54, 56, a relative rotational adjustment of the rings of that set will result in a significantly larger tilt than results from a relative rotation adjustment of the same amount between the rings 50, 52. Thus, adjustment of the ring set 54, 56 serves as a "coarse" adjustment of the overall tilt, while adjustment of the ring set 50, 52 serves as a "fine" adjustment of the overall tilt.

In a variation of the FIG. 5 embodiment, the rings 52 and 54 may be a single ring, or may be fused together. This would prevent relative movement between the two ring sets and avoid a situation in which each ring set imposes a tilt in a different angular direction relative to the rotational axis. If the rings 52, 54 were manufactured as a single ring, careful machining of the top and bottom surfaces would be required to ensure the desired angles. It is also possible to use separate rings 52, 54, and to provide a blocking mechanism, such as clamping screws, to prevent a relative rotation between them. Suitable tools for manual or automated operation may also include a means for preventing such a relative rotation.

Figure 6:
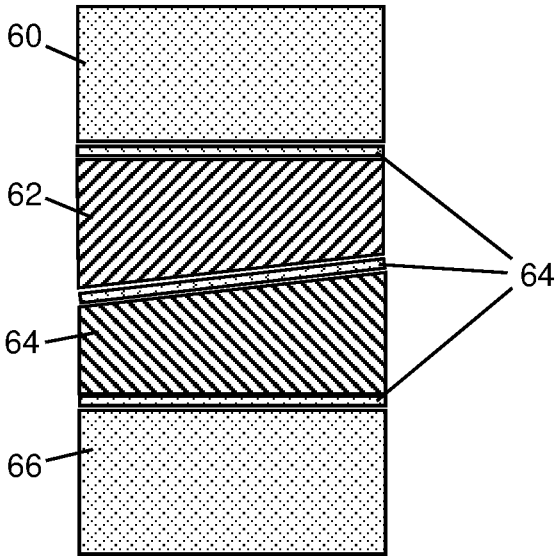
FIG. 6 is a schematic, cross-sectional view of the interfaces between two spacers and two components, and the use of friction bearings therebetween.

Because many embodiments of the invention will involve magnets that generate strong attraction forces this, in turn, leads to a high degree of friction between the spacers, and strong rotating forces may therefore need to be applied when rotating them. It is therefore preferable that the surfaces of the spacers that move relative to corresponding surfaces have a low surface roughness to avoid high friction forces. A low friction surface coating could also be used on these surfaces or, alternatively, a friction bearing could be located between them. FIG. 6 is a cross-sectional view of an isolated region of a set of spacer rings 62, 64 (like those of FIG. 4) that separate magnetic components 60, 66. In this embodiment, friction bearings 64 are used between the outer surfaces of the ring set and the modules that they contact, as well as between the two spacer rings themselves. Friction bearings are known in the art, and existing materials for this purpose may be shaped to fit between the spacer rings as necessary.

Figure 7:
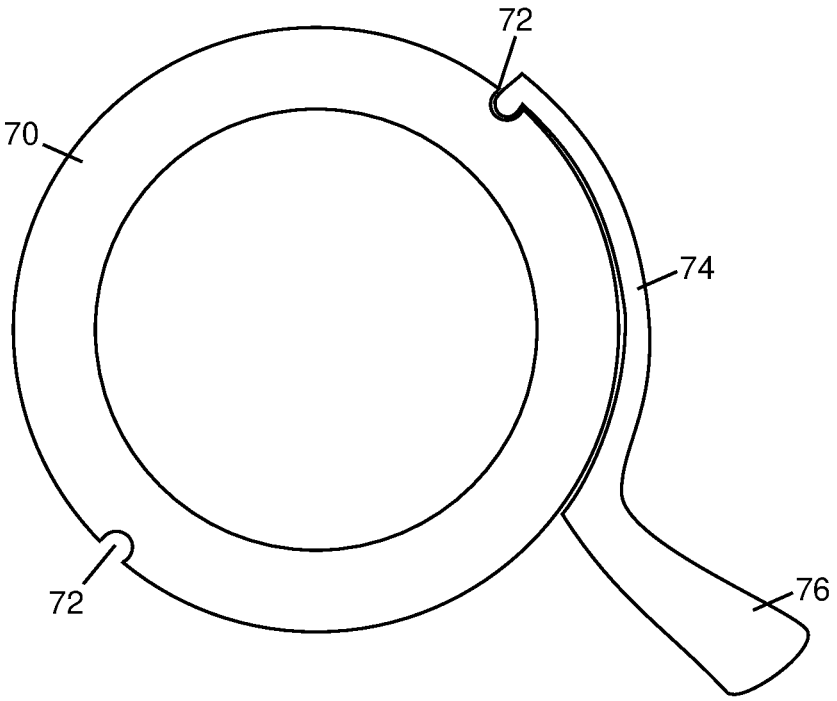
FIG. 7 is a schematic view of a spacer ring according to the invention that has a concave feature that may be engaged with a manual tool for facilitating rotation of the ring.

Because the relative rotation of spacer rings like those shown herein may require a significant amount of force, the invention further includes certain means of facilitating such a rotation. FIG. 7 shows a spacer ring 70 like those disclosed herein that is fabricated with at least one concave notch 72 in its periphery that is sized to allow the introduction of a tool such as spanner wrench 74. The spanner wrench is sized to fit the ring 70 and engage the notch 72, and has a handle 76 to allow a user to grip the wrench and use it to apply a rotational force to the ring. Once the desired rotation of the ring is achieved, the wrench is removed until further adjustment is required.

Figure 8:
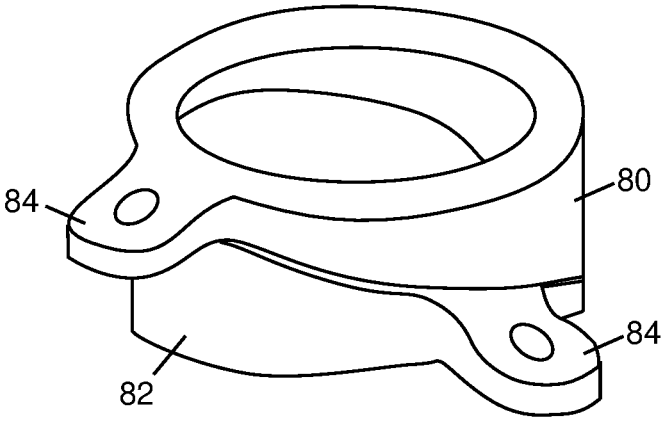
FIG. 8 is a schematic view of a spacer ring pair for which each ring has a protruding feature that may be engaged by an external tool.

It is anticipated that, in very large embodiments, such as might be necessary for magnetic resonance imaging (MRI) systems, pneumatics, hydraulics, reduction gearing, or other high-force means may be used to overcome any forces needed to rotate the wedge-rings at larger scales. In such an embodiment, the spacer rings may incorporate any of a variety of different possible details to allow them to be rotated by high-force actuation. FIG. 8, for example, shows a pair of spacer rings 80, 82 each with a notched protrusion 84 that may be contacted by an appropriate actuator. Such features, including complex external notches, gear-teeth, etc., may be added during fabrication of the spacers via laser cutting, blanking or any other known technique.

Figure 9:
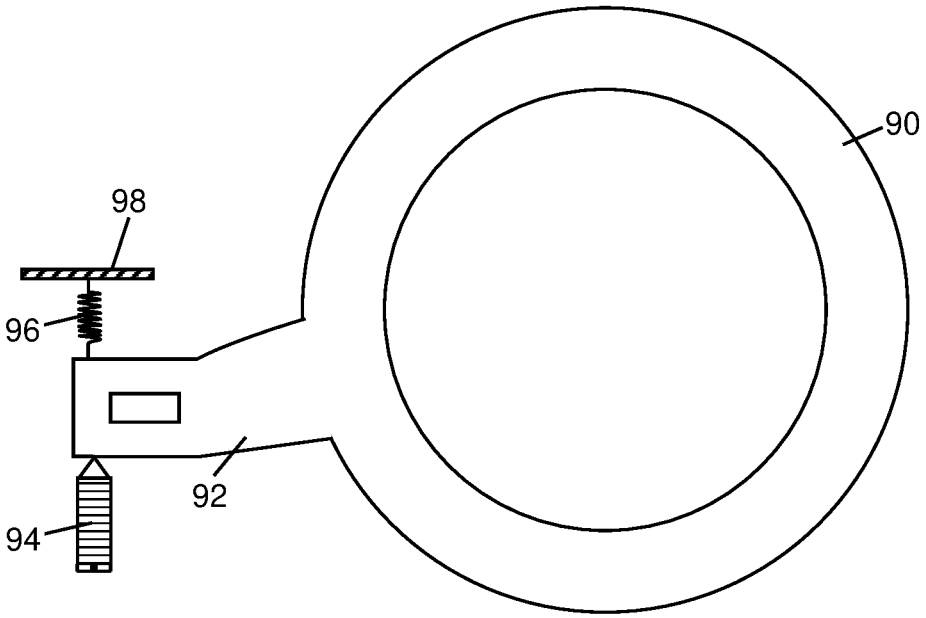
FIG. 9 is a schematic view of a spacer ring according to the invention that has a protruding feature that is located between an adjustment screw and a compression spring to allow controlled adjustment of the spacer rotation.

Another possible adjustment mechanism is shown schematically in FIG. 9. In this embodiment, a spacer ring 90 has an integral tab 92 that extends radially from the spacer. To allow precise rotation of the spacer ring 90, the tab 92 is contacted by a screw 94 that is mounted in a fixed, threaded housing (not shown). Rotation of the screw 94 advances it gradually, providing a corresponding gradual rotation of the spacer ring 90. While not necessary, this embodiment also shows a compression spring 96 in contact with an opposite side of the tab 92. The spring is mounted to a fixed surface 98, and the opposing force that it provides relative to the force of the screw ensures a controlled advancement of the spacer rotation.

When adjusting tilt using the present invention, it is important that there is no lateral movement between the spacers so as to retain a common rotational axis. Depending on the form of the spacers, this can be done using a spindle or pin at the center, or by some type of bearing that impedes lateral motion. In one embodiment, the adjustment device is shaped with a circumferential groove or projection for guiding the rotational movement such that a lateral gliding off can be avoided. If the spacers are annular, as discussed above, lateral displacement may be restricted by a central projection or a pin that engages a central hole of the spacers. For such a restriction, it is necessary to allow enough clearance that the rotation of the spacer will not cause it to jam against the projection. However, with the appropriate tolerance, the alignment of the spacers may be preserved without obstructing the rotation.

Figure 10:
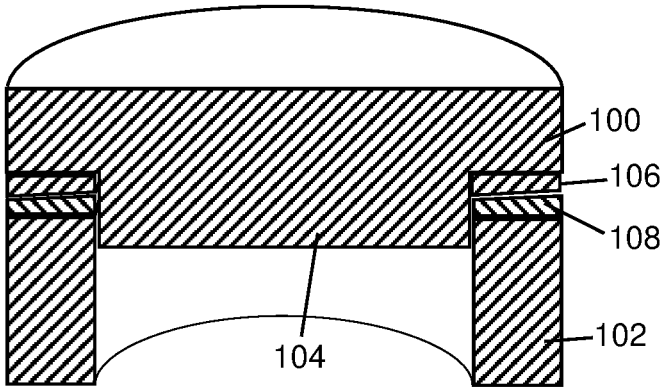
FIG. 10 is a schematic, cross-sectional view of a first set of magnetic circuit components that use the adjustment apparatus of the invention, and that include an obstruction that minimizes relative radial displacement of the components and spacers.
Figure 11:
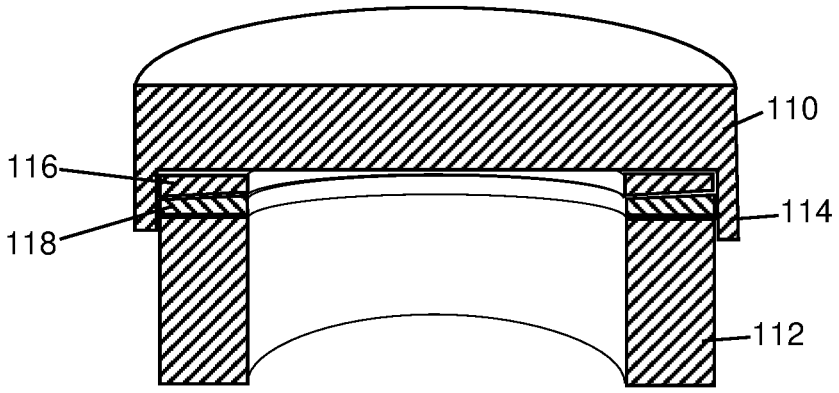
FIG. 11 is a schematic, cross-sectional view of a second set of magnetic circuit components that use the adjustment apparatus of the invention, and that include a different type of obstruction for minimizing relative radial displacement.
Figure 12:
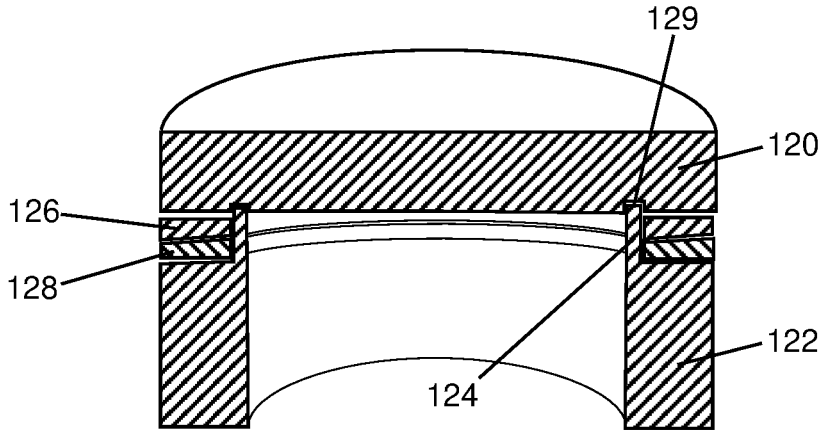
FIG. 12 is a schematic, cross-sectional view of a third set of magnetic circuit components that use the adjustment apparatus of the invention, and that include yet another, different type of obstruction for minimizing relative radial displacement.

FIGS. 10-12 show, in cross section, different possible configurations of parts separated by annular spacers for which the parts have features that limit lateral movement when the parts are assembled together. In FIG. 10, a first part 100 has a protruding portion 104 within an inner radius of the spacer rings 106, 108 that separate it from part 102. The protruding portion 104 prevents relative lateral movement of both the spacers 106 108 and the components 102, 104. FIG. 11 is a similar arrangement but, rather than an inner protrusion, the part 110 has an overlap 114 that encompasses the spacer rings 116, 118 and an upper region of the part 112. The arrangement of FIG. 12 is different in that the lower part 122 has a protrusion 124 that resides within an inner circumference of the spacer rings 126, 128, and that engages a groove 129 in the upper part 120 (a "key and slot" feature). As mentioned above, each of the embodiments of FIGS. 10-12 is such that the restricting feature that prevents relative lateral movement of the parts and the spacer rings provides enough clearance to the rings that it will not impede the rotation of one of the rings due to the eccentricity of the elliptical shape of the interior radius formed at the face contacting the other ring.

Those skilled in the art will recognize that, if the outer circumference of the spacer rings is circular, the faces of the wedged rings that contact each other will be slightly elliptical. As a consequence, when rotating one of the rings, a part of the ring may protrude laterally relative to an interior or exterior surface of the other ring. For magnetic resonance devices, the angular adjustment due to fabrication tolerances is generally below 1°-2°. Thus, a plausibility calculation has been established for an angular adjustment of $\alpha<0.1$ rad (corresponding to about 5.73°). The maximum deviation $\Delta R$ from a circular shape may be calculated as follows:

$$\Delta R=R(1/\cos\alpha-1)$$

For small angles of $\alpha<0.1$ rad it is assumed that: $1/\cos\alpha\sim1+\alpha2/2$ so that:

$$\Delta R\sim R(1+\alpha^2/2-1)=R\alpha^2/2$$

Thus, within this range, the radial deviation due to elliptical eccentricity is approximately (0.05)R, and the maximum diameter of the ellipse is D+(0.01)D, which is negligible for magnetic resonance applications.

Figure 13:
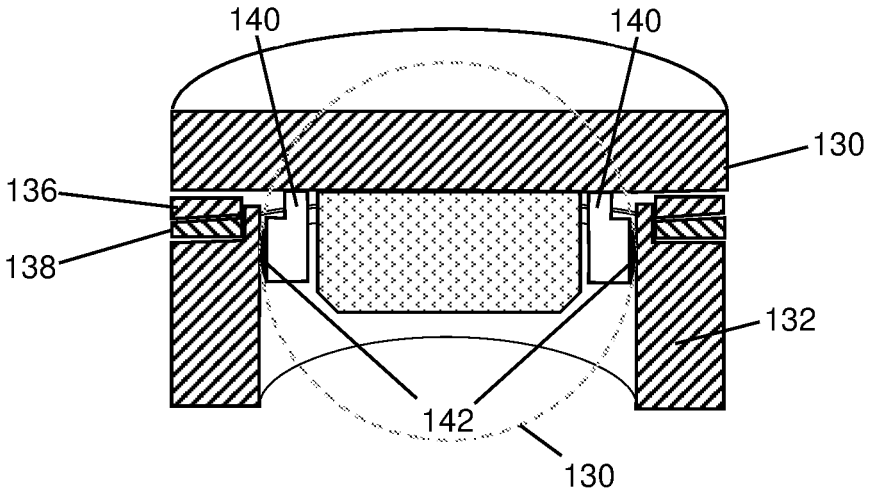
FIG. 13 is a schematic, cross-sectional view of a set of magnetic circuit components that use the adjustment apparatus of the invention, and that include an obstruction with a curved surface for minimizing relative radial displacement while also minimizing relative surface friction during tilt adjustment.

FIG. 13 shows a different embodiment that preserves the alignment of an upper part 130 and attached pole face 134 relative to a lower part 132, which may be a housing. Spacer rings 136, 138 may be adjusted to provide a desired relative tilt between the upper part 130 and lower part 132, as in previous embodiments, but to preserve the relative lateral positioning of the parts, alignment components 140 fixed to the upper part extend into a space between the pole face 134 and the lower part 132. Although these are shown as two discrete elements, those skilled in the art will recognize that this could also be a single annular component that follows the inner diameter of the lower part.

Although the alignment components 140 have a snug fit with the lower part, and thereby preserve a close lateral relationship between the lower part and the upper part, the surfaces 142 that make contact with the inner diameter of the lower part follow a spherical surface. This allows the desired tilt adjustment without the problem of physical jamming that would occur if the surfaces 142 were had no curvature in a direction parallel to the rotational axis about which the spacer rings are rotated. This curvature is shown in FIG. 13 as a circular broken line 144, and is selected to have a center that is close to a center of curvature about which the tilt adjustment occurs. Curved surfaces such as these may also be used in other embodiments to avoid relative obstruction between contacting surfaces when a tilt adjustment is performed.

While the invention has been shown and described with reference to exemplary embodiments thereof, those skilled in the art will recognize that various changes may be made therein without departing from the spirit and scope of the invention as defined by the appended claims. Moreover, those skilled in the art will understand that the drawings shown herein are schematic and not necessarily to scale, and are intended to most clearly show the principles of the invention.

The invention claimed is:

1. An adjustment apparatus for adjusting an angular tilt of a first component of a magnetic circuit relative to an alignment axis of a second component of the magnetic circuit, comprising:

a first spacer having a thickness, between a first support surface adjacent to the first component and a first adjustment surface on a side of the first spacer opposite the first support surface, that varies continuously from a minimum to a maximum over an angular range of 180° about the alignment axis; and a second spacer having a thickness, between a second support surface adjacent to the second component and a second adjustment surface on a side of the second spacer opposite the second support surface, that varies continuously from a minimum to a maximum over an angular range of 180° about the alignment axis;

wherein the first adjustment surface and the second adjustment surface are adjacent to each other and have a relative rotational position about the alignment axis that, when adjusted, changes a relative angular orientation of the first support surface and the second support surface.

2. An adjustment apparatus according to claim 1 wherein, at a minimum adjustment position, the maximum thickness of the first spacer is rotationally aligned with the minimum thickness of the second spacer and, at a maximum adjustment position the maximum thickness of the first spacer is rotationally aligned with the maximum thickness of the second spacer.

3. An adjustment apparatus according to claim 1 wherein the second support surface is substantially perpendicular to the alignment axis, and wherein, at a minimum adjustment position, the first support surface is substantially parallel to the second support surface.

4. An adjustment apparatus according to 1 wherein a shape of each of the first and second spacers is substantially identical.

5. An adjustment apparatus according to claim 1 wherein the first and second spacers are ring-shaped and centered relative to the alignment axis.

6. An adjustment apparatus according to claim 1 wherein the first and second spacers are disc-shaped and centered relative to the alignment axis.

7. An adjustment apparatus according to claim 1 wherein the first and second spacers are a coarse set of spacers, and wherein the adjustment apparatus further comprises a fine set of spacers that are identical to the spacers of the coarse set except that a variation in a thickness of each of the spacers of the fine set over an angular range of 180° about the alignment axis is significantly less than said variation in the thickness of the spacers of the coarse set, the fine set of spacers being adapted to reside between the coarse set of spacers and one of the components such that a coarse adjustment in said angular tilt is achieved by adjusting the relative rotational position of the spacers of the coarse set, while a fine adjustment in said angular tilt is achieved by adjusting a relative rotational position of the spacers of the fine set.

8. An adjustment apparatus according to claim 1 further comprising at least one friction bearing located between one of the spacers and at least one of an adjacent component and an adjacent spacer.

9. An adjustment apparatus according to claim 1 wherein, in an operating region of the magnetic circuit, magnetic field lines of the magnetic circuit are substantially parallel to the alignment axis.

10. An adjustment apparatus according to claim 1 further comprising a tool that engages with a feature of at least one of the spacers and enables said relative rotational adjustment via displacement of the tool.

11. An adjustment apparatus according to claim 1 wherein at least one of the first component and the second component has an obstructing feature that minimizes radial movement of the first component relative to the alignment axis.

12. An adjustment apparatus according to claim 11 wherein said obstructing feature minimizes radial movement of the spacers relative to the alignment axis.

13. An adjustment apparatus according to claim 11 wherein said obstructing feature has a curved surface that minimizes friction between the first component and the second component during adjusting of said angular tilt.

14. A method of adjusting an angular tilt of a first component of a magnetic circuit relative to an alignment axis of a second component of the magnetic circuit, the method comprising:

providing a first spacer having a thickness, between a first support surface and a first adjustment surface on a side of the first spacer opposite the first support surface, that varies continuously from a minimum to a maximum over an angular range of 180° about the alignment axis;

providing a second spacer having a thickness, between a second support surface and a second adjustment surface on a side of the second spacer opposite the second support surface, that varies continuously from a minimum to a maximum over an angular range of 180° about the alignment axis;

locating the first adjustment surface and the second adjustment surface adjacent to each other with the first support surface adjacent to the first component and the second support surface adjacent to the second component; and changing a relative rotational position of the first spacer and the second spacer about the alignment axis so as to change a relative angular orientation of the first support surface and the second support surface.

15. A method according to claim 14 wherein, at a minimum adjustment position, the maximum thickness of the first spacer is rotationally aligned with the minimum thickness of the second spacer and, at a maximum adjustment position the maximum thickness of the first spacer is rotationally aligned with the maximum thickness of the second spacer.

16. A method according to claim 14 wherein the second support surface is substantially perpendicular to the alignment axis, and wherein, at a minimum adjustment position, the first support surface is substantially parallel to the second support surface.

17. A method according to claim 14 wherein a shape of each of the first and second spacers is substantially identical.

18. A method according to claim 14 wherein the first and second spacers are ring-shaped and centered relative to the alignment axis.

19. A method according to claim 14 wherein the first and second spacers are disc-shaped and centered relative to the alignment axis.

20. A method according to claim 14 wherein the first and second spacers are a coarse set of spacers, and wherein the method further comprises:

providing a fine set of spacers that are identical to the spacers of the coarse set except that a variation in a thickness of each of the spacers of the fine set over an angular range of 180° about the alignment axis is significantly less than said variation in the thickness of the spacers of the coarse set;

locating the fine set of spacers between the coarse set of spacers and one of the components;

making a coarse adjustment in said angular tilt by adjusting the relative rotational position of the spacers of the coarse set; and making a fine adjustment in said angular tilt by adjusting a relative rotational position of the spacers of the fine set.

21. A method according to claim 14 further comprising locating at least one friction bearing between one of the spacers and at least one of an adjacent component and an adjacent spacer.

22. A method according to claim 14 further comprising providing a tool that engages with a feature of at least one of the spacers, and performing said relative rotational adjustment via displacement of the tool.

* * * * *